US008197210B1

(12) United States Patent
Liang

(10) Patent No.: US 8,197,210 B1
(45) Date of Patent: Jun. 12, 2012

(54) TURBINE VANE WITH LEADING EDGE INSERT

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 1195 days.

(21) Appl. No.: 11/900,036

(22) Filed: Sep. 7, 2007

(51) Int. Cl.
*F01D 5/18* (2006.01)
*F01D 5/28* (2006.01)
*F01D 9/04* (2006.01)

(52) U.S. Cl. ..... 416/96 A; 416/97 R

(58) Field of Classification Search ..... 415/115; 416/96 R–96 A, 97 R
See application file for complete search history.

(56) References Cited

U.S. PATENT DOCUMENTS 4,026,659 A * 5/1977 Freeman, Jr. ..... 415/115
4,565,490 A * 1/1986 Rice ..... 415/114
5,090,866 A * 2/1992 Blair ..... 415/115
5,207,556 A * 5/1993 Frederick et al. ..... 415/115
5,779,437 A * 7/1998 Abdel-Messeh et al. ..... 415/115
6,874,988 B2 * 4/2005 Tiemann ..... 415/115
2001/0018019 A1 * 8/2001 Jang et al. ..... 415/115
* cited by examiner

*Primary Examiner* — Edward Look
*Assistant Examiner* — Jesse Prager
(74) *Attorney, Agent, or Firm* — John Ryznic

(57) ABSTRACT

A turbine stator vane, especially for use in the first stage of an industrial gas turbine engine, the vane including an inner endwall and an outer endwall each with an endwall overhang extending there from, and second and third cooling supply cavities formed between the endwalls and the pressure and suction side walls of the airfoil. The outer endwall includes an end cap with an opening to secure a nose piece therein, and the inner endwall includes an opening to insert the nose piece therein. A nose piece having the shape of the airfoil leading edge is inserted into the openings of the endwall and secured therein by welding. The nose piece includes a showerhead of film cooling holes with shallow angles of discharge. A leading edge impingement tube is secured within the nose piece to provide impingement cooling for the nose piece. Second and third impingement tubes are secured within the second and third cavities to provide impingement cooling therein. Receded gaps are formed in the endwalls between the nose piece, and streamwise film cooling holes in the ends of the nose piece and aligned with the gaps in the endwalls eject cooling air from the nose piece into the gaps for cooling. Because of the separated nose piece from the main vane assembly, film cooling holes of a shallow angle can be formed for providing a better film cooling layer to the vane leading edge and therefore allow for exposure to higher gas flow temperatures.

11 Claims, 5 Drawing Sheets

TURBINE VANE WITH LEADING EDGE INSERT

BACKGROUND OF THE INVENTION

1. Field of the Invention

The present invention relates generally to gas turbine engines, and more specifically to a turbine stator vane with a cooled leading edge.

2. Description of the Related Art Including Information Disclosed Under 37 CFR 1.97 and 1.98

A gas turbine engine includes a turbine with a number of stages of stator vanes and rotor vanes to guide and extract energy from the hot gas flow passing through the turbine. The first stage vanes and blades are exposed to the highest temperature and therefore are the most critical for cooling. The efficiency of the engine can be increased by passing a higher temperature gas flow into the turbine.

First stage stator vanes used in an industrial gas turbine engine also must be capable of lasting up to 48,000 hours under these extreme operating conditions. Erosion or oxidation damage to a turbine part can cause significant decreases in the engine efficiency or performance. A damaged part, such as the first stage turbine vane, could result in early shutdown of the engine.

In a stator vane, the horseshoe vortex flow phenomenon is created by the combination of hot flow core gas radial velocity and static pressure gradient forces exerted at the intersection of the airfoil leading edge and the endwall of the vane. As the hot flow core gas enters the turbine with a boundary layer thickness and collides with the leading edge of the vane airfoil, the horseshoe vortex separates into a pressure side and suction side downward vortices. Initially, the pressure vortex sweeps downward and flows along the airfoil pressure side forward fillet region first. Then, due to the hot flow channel pressure gradient from the pressure side to the suction side, the pressure side vortex migrates across the hot flow passage and ends up at the suction side of the adjacent airfoil. As the pressure side vortex rolls across the hot flow channel, the size and strength of the passage vortex becomes larger and stronger. Since the passage vortex is much stronger than the suction side vortex, the suction side vortex will flow along the airfoil suction side fillet and act as a counter vortex for the passage vortex.

FIG. 1 shows a schematic view of the vortices formation for a boundary layer entering a turbine airfoil of the prior art. As a result of these vortices flow phenomena, some of the hot core gas flow from the upper airfoil span is transferred toward a close proximity to the endwall and therefore creates a high heat transfer coefficient and high gas temperature region at the airfoil fillet region.

As shown in FIG. 1, the resulting forces drive the stagnated flow that occurs along the airfoil leading edge towards the region of lower pressure at the intersection of the airfoil and endwall. This secondary flow flows around the airfoil leading edge fillet and endwall region. The secondary flow then rolls away from the airfoil leading edge and flows upstream along the endwall against the hot core gas flow as seen in FIG. 2 by reference number 11. As a result, the stagnated flow forces acting on the hot core gas and radial transfer of hot core gas flow from the upper airfoil span toward a close proximity to the endwall creates a high heat transfer coefficient and a high gas temperature at the intersection location.

Injection of film cooling air at discrete locations along the horseshoe vortex region is used to provide the cooling for this region. However, there are many problems for this type of film blowing injection process. High film effectiveness is difficult to establish and maintain in the high turbulent environment and high pressure variation region such as the horseshoe vortex region. Film cooling is very sensitive to pressure gradient. The mainstream pressure variation is very high at the horseshoe vortex location. The spacing between the discrete film cooling holes and areas immediately downstream of the spacing are exposed to less or to no film cooling air at all. Consequently, these areas are more susceptible to thermal degradation and over-temperature.

Cooling of the fillet region by means of conventional backside impingement cooling yields an insufficient result due to the thickness of the airfoil fillet. And, drilling film holes at the airfoil fillet to provide film cooling produces unacceptable stress by the film cooling holes. An alternative way of cooling the fillet region is by injection of film cooling air at discrete locations along the airfoil periphery and endwall into the vortex flow to create a film cooling layer for the fillet region. The film layer migration onto the airfoil fillet region is highly dependant on the secondary flow pressure gradient. For the airfoil pressure side and suction side downstream section, this film injection process provides adequate cooling as seen in FIGS. 4 and 5. However, for the fillet region immediately downstream of the airfoil leading edge, where the mainstream or secondary pressure gradient is in the streamwise direction, the injection of film cooling air from the airfoil or endwall surface will not be able to migrate the cooling flow to the fillet region to create a film sub-boundary layer for cooling that particular section of the fillet.

In addition to the high heat load generated by the horseshoe vortex flow around the airfoil leading edge versus the endwalls junction and the secondary flow accelerated around the airfoil fillet region cooling issue. The first vane normally includes a very long overhang inner diameter endwall and outer diameter endwall on the inlet side of the vane. Use of the long endwalls prevents the use of shallow angled showerhead film cooling holes for the airfoil leading edge region, especially when the showerhead is fabricated with the use of laser drilling for the holes. Drilling holes using a laser requires a larger space between the laser beam and the endwall overhang. As a result of this manufacturing constraint, showerhead hole angles such as 45 degrees are used for the leading edge regions which yields low film coverage, a low film effectiveness and a poor internal convective area. This results in a hotter airfoil leading edge metal temperature or requires more cooling flow for maintain a lower metal temperature that would be provided for by using shallow angled film holes instead.

BRIEF SUMMARY OF THE INVENTION

A turbine stator vane, such as a first stage turbine vane with a long endwall overhang, in which the airfoil leading edge nose section is a single separate piece that is installed onto the vane assembly in which the nose piece can have shallow angled showerhead film cooling holes of less than 25 degrees formed within the nose piece. The showerhead film cooling holes on the leading edge nose piece can all be in the same direction, or the upper half can be directed downward and the lower half can be directed upward. Also, additional film cooling holes around the leading edge fillet on both the pressure side and suction side can be included. All the leading edge cooling holes near the airfoil versus the endwall junction can be extended below the airfoil endwall.

In the inner diameter feed cooling design, an indentation with a closed end is formed at the outer diameter endwall around the leading edge nose piece. While the indentation for the inner diameter endwall is similar to the outer diameter endwall construction but with an open end to receive the leading edge piece. A spacer is formed within the indentation around the leading edge nose piece. This creates a space wrapped around the airfoil leading edge, pressure and suction sides for the nose piece versus the endwall intersection location. The resulting peripheral space allows for the airfoil leading edge diameter as well as the fillet around the leading edge pressure and suction sides to be extended below the boundary wall and submerged within the gap. Since the size of the horseshoe vortex is a strong function of the airfoil leading edge diameter, the depth and width dimension in-between the airfoil leading edge and endwall will be determined based upon each individual turbine vane airfoil leading edge diameter as well as the turbine inlet conditions. As a result, the spacing around the airfoil leading edge piece need not be at a constant distance from the endwall.

At the airfoil leading edge region, cooling air is injected within the spacer around the leading edge nose piece peripheral. The showerhead film cooling holes that are angled downward in the same direction and align with the down draft hot gas flow. Since the space is created below the endwall and at increased volume to diffuse or slow down the secondary hot gas flow, and increased buildup of the film layer for the injected cooling air will be retained within the gap. Around the leading edge pressure and suction sides root section, cooling air is injected within the spacer at the aft-ward orientation throughout the internal surface of the airfoil wall for providing a film layer to cool the airfoil wall. Since the space is created below the endwall, the real fillet section for the airfoil leading edge will be located outside of the boundary wall and therefore there is no need for cooling.

DETAILED DESCRIPTION OF THE INVENTION

Figure 1:
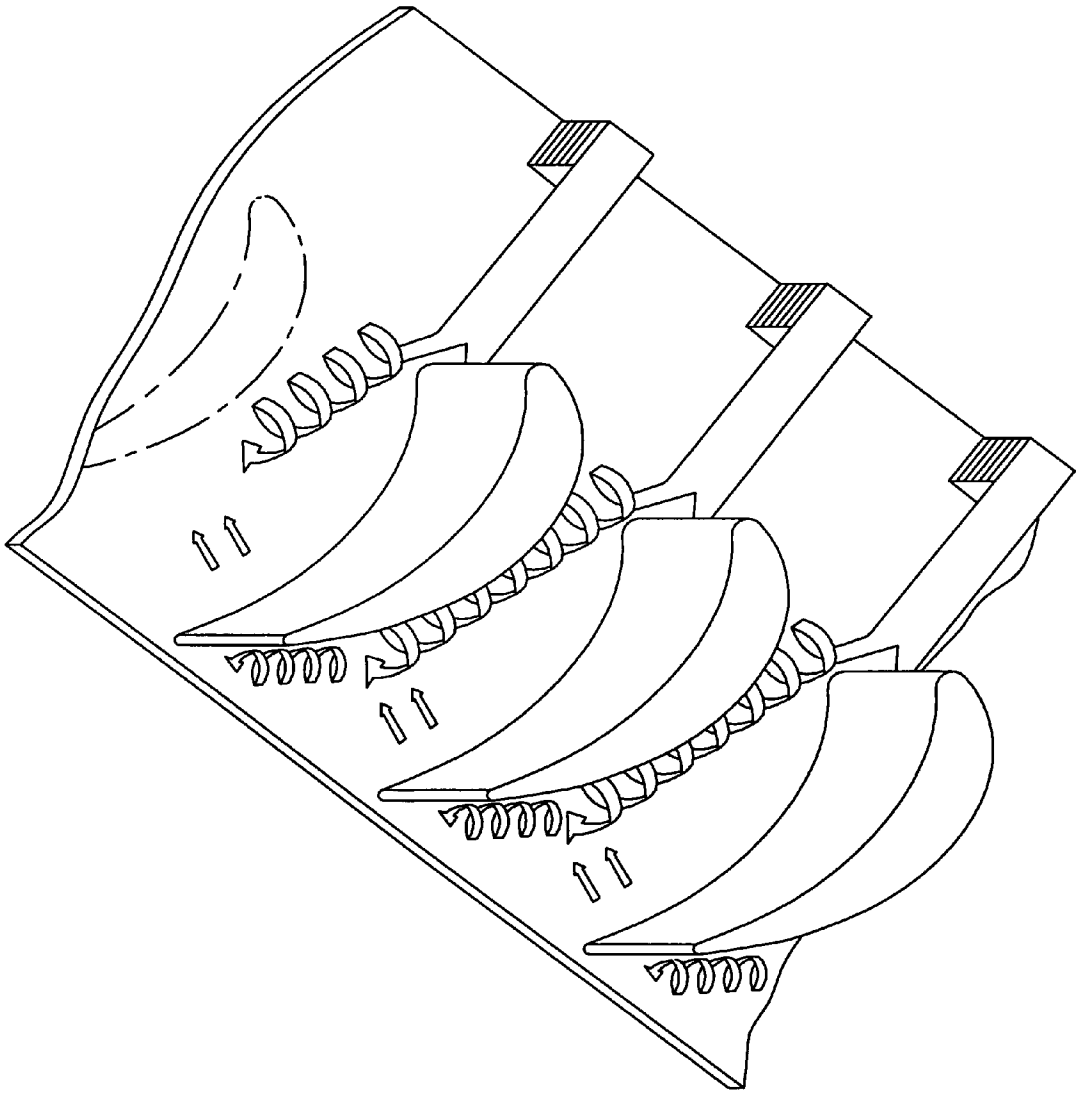
Fig 1 Prior Art
FIG. 1 shows a schematic view of the vortex flow path through adjacent turbine vanes in a gas turbine engine.
Figure 2:
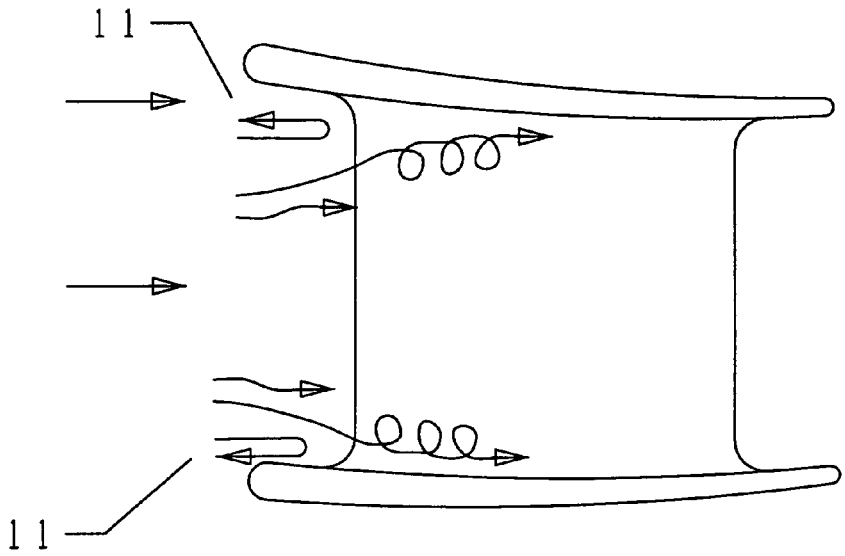
Fig 2 Prior Art
FIG. 2 shows a side view of the secondary flow direction through the vanes.
Figure 3:
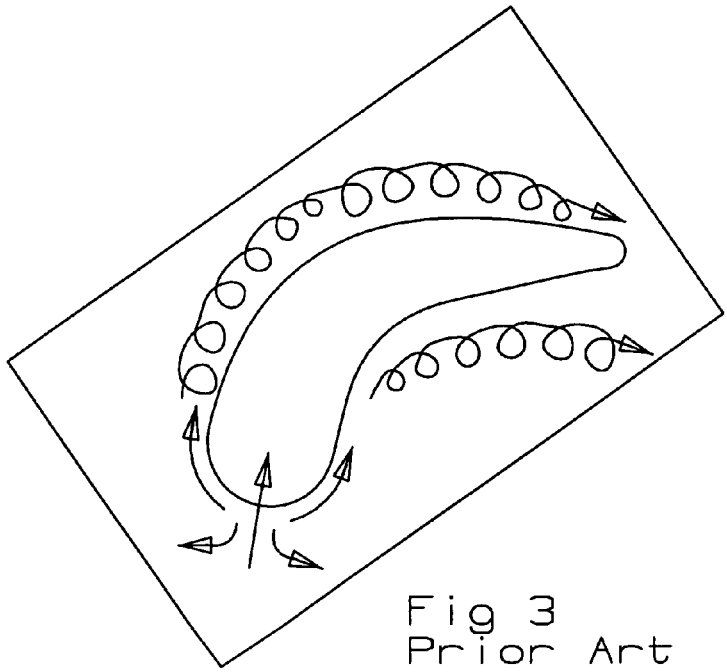
Fig 3 Prior Art
FIG. 3 shows a top view of the secondary flow direction through the vanes.
Figure 4:
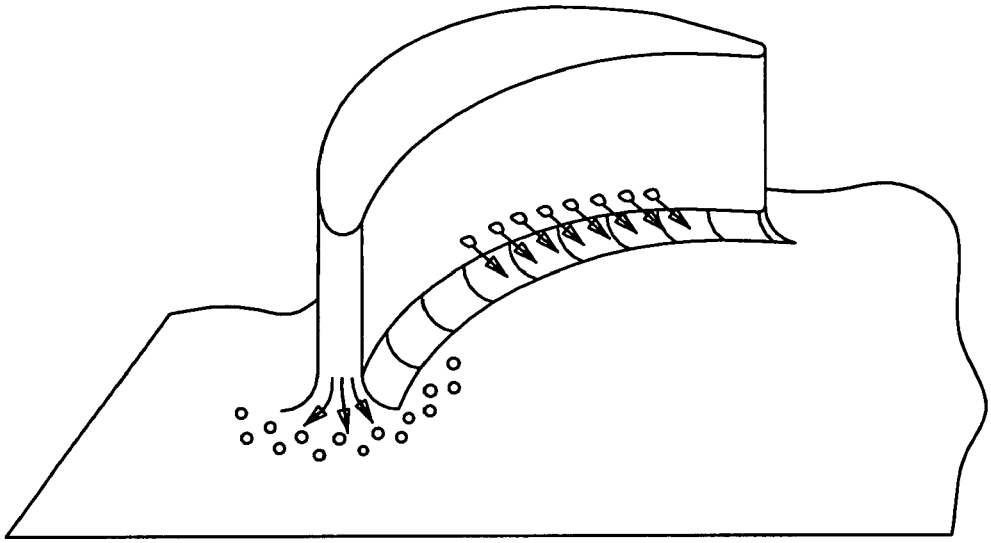
Fig 4 Prior Art
FIG. 4 shows a schematic view of a turbine vane with the pressure side fillet region cooling of the prior art vane.
Figure 5:
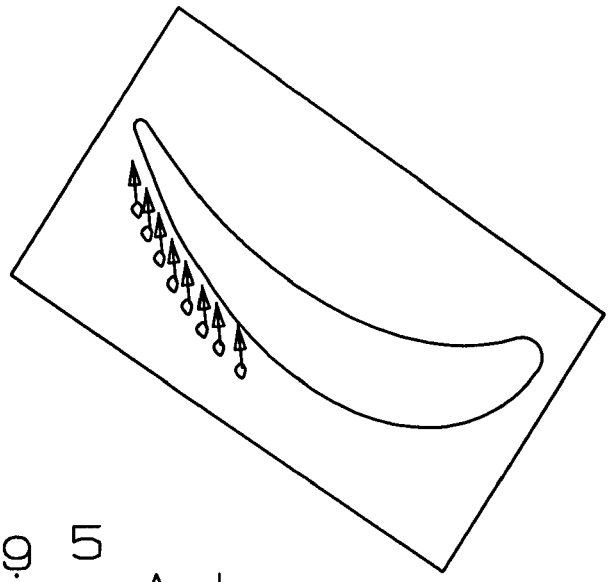
Fig 5 Prior Art
FIG. 5 shows a top view of a turbine vane with the suction side fillet region cooling of the prior art vane.
Figure 6:
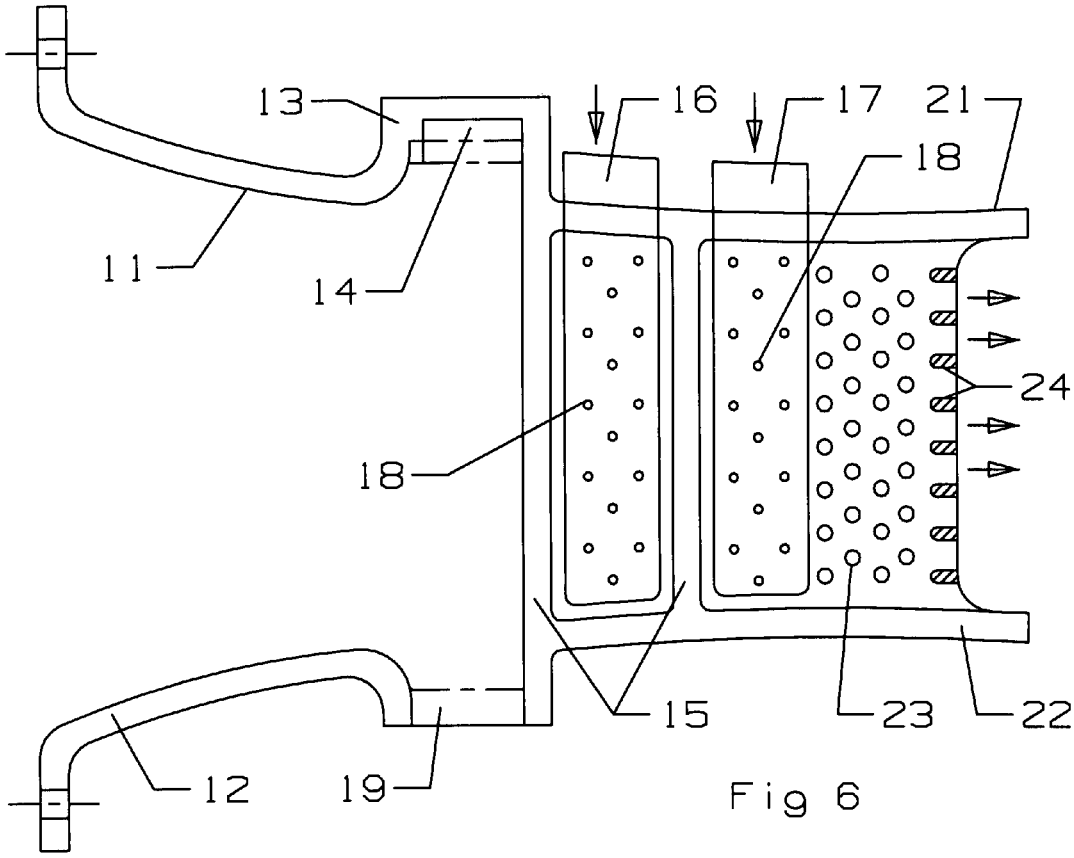
FIG. 6 shows a side cross section view of the stator vane of the present invention without the leading edge nose piece.

The first stage stator vane of the present invention is shown in FIGS. 6 through 9 with FIG. 6 showing a cross section of the main assembly. The vane main assembly includes an outer diameter endwall overhang 11, an inner diameter endwall overhang 12, an end cap 13 on the outer diameter endwall side with an inner opening 14 to receive the leading edge nose piece (described below), ribs 15 extending between the two endwalls, a second impingement tube 16, a third impingement tube 17, impingement cooling holes 18 in both of the impingement tubes, an outer diameter endwall 21, an inner diameter endwall 22, pin fins 23 extending between the pressure side and the suction side of the vane airfoil, and cooling air exit slots 24 arranged along the trailing edge of the airfoil. An opening 19 on the inner diameter side of the endwall overhang allows for the insertion of the leading edge nose piece.

Figure 7:
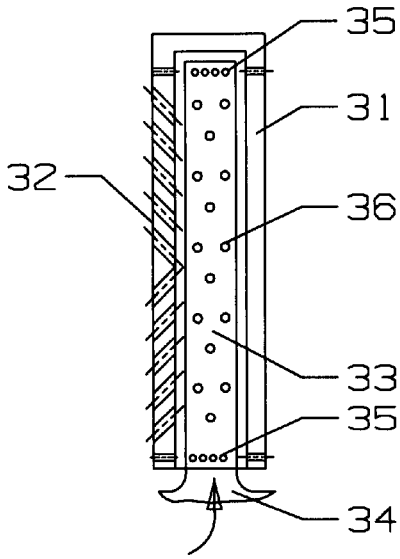
FIG. 7 shows a side cross section view of the leading edge nose piece of the present invention.

FIG. 7 shows a side cross section view of the leading edge nose piece 31 that is inserted into the opening 19 and the inner opening 14 of the main vane assembly. The nose piece 31 includes leading edge film cooling holes 32 that form a showerhead in which the holes 32 are formed at a shallow angle. All of the showerhead holes 32 can be aligned in one direction or the holes 32 can be divided into an upper half directed downward and a lower half with the holes 32 angled upward as seen in FIG. 7. An impingement tube 33 with a number of impingement cooling holes 36 formed therein is inserted into the nose piece 31. The impingement tube 33 includes a fluted inlet end 34 in which the cooling air is supplied.

Figure 8:
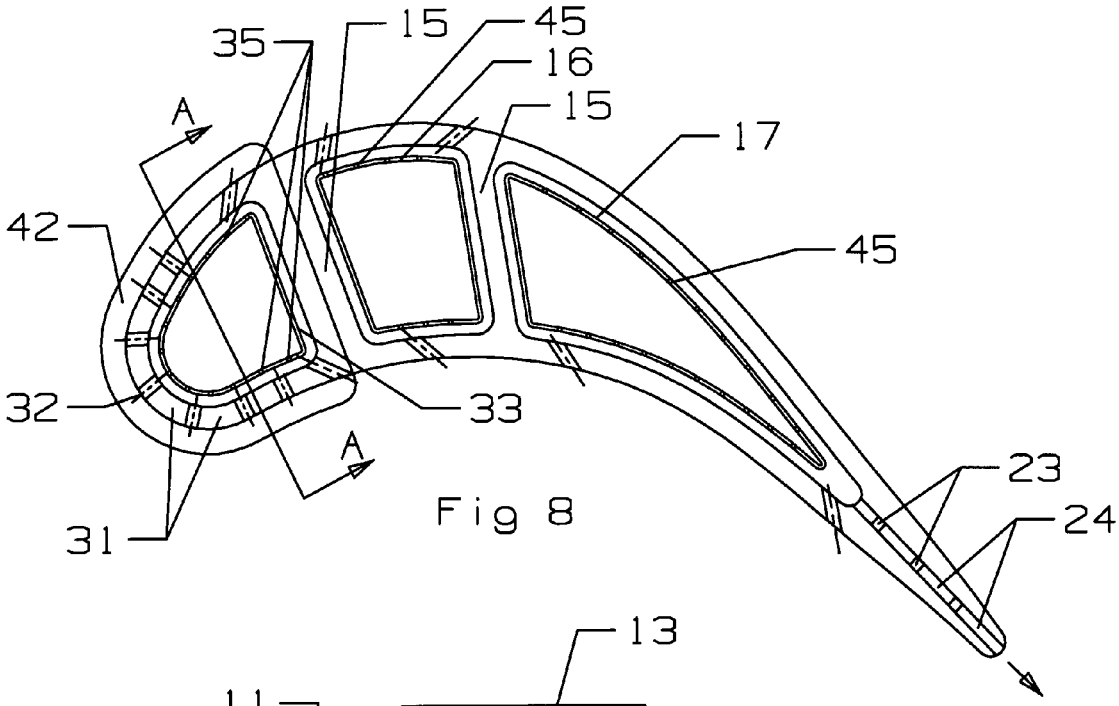
FIG. 8 shows a top cross section view of the turbine vane of the present invention.
Figure 9:
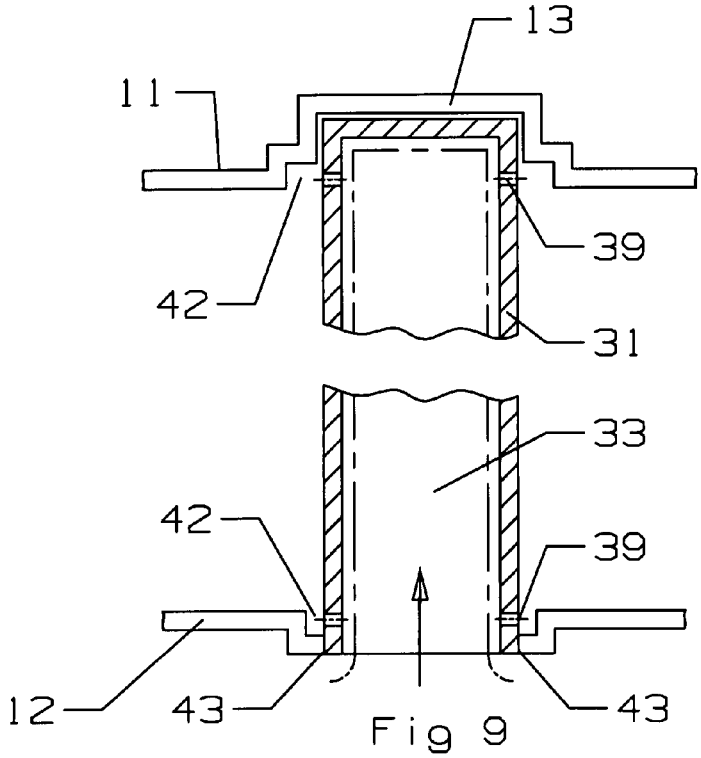
FIG. 9 shows a front cross section view of the leading edge nose piece taken along the line A-A in FIG. 8

FIG. 8 shows a top cross section view of the vane with the nose piece 31 inserted into the opening to form the leading edge and showerhead film cooling hole arrangement. The vane airfoil includes the pressure side and the suction side walls. The pin fins 23 along the trailing edge region extend from the side walls, and the exit slots 24 connect the trailing edge cavity (in which the impingement tube 17 is located) to the outside of the trailing edge of the blade. The impingement tube 16 is located within a mid-chord cavity of the airfoil. Rows of film cooling holes 45 connect the cavities to the pressure and suction side walls to discharge cooling air from the cavity and onto the surface of the airfoil. The nose piece 31 is located within the leading edge region of the vane and includes the impingement tube 33 secured within the nose piece 31. The film cooling holes 36 of the impingement tube 33 are spaced around the impingement tube 33 to provide impingement cooling for the inner walls of the nose piece 31. The film cooling holes 32 that form the showerhead are arranged on the leading edge section of the nose piece 31, and additional film cooling holes and gill hoes on both the pressure side and the suction side are located on the nose piece 31. FIG. 9 shows the nose piece 31 secured within the end cap 13 of the outer diameter endwall 1 and the hole or opening of the inner diameter endwall 12. Gaps 42 are formed between the endwalls and the nose piece 31. The gaps 42 are shown extending around the leading edge of the nose piece on both the pressure side and suction side as seen in FIG. 8. Streamwise film cooling holes 39 are located on the upper portion and the lower portions of the nose piece and discharge cooling air into the gap 42 as shown in FIG. 9. The impingement tube 33 is located within the nose piece 31 and includes the opening or inlet extending out from the bottom of the inner endwall 12 and the nose piece 31. The cooling holes 35 of the impingement tube 33 are aligned with the streamwise film cooling holes 39 of the insert so that the cooling air from within the insert 33 will flow out holes 35 and impinge on the inner surface of the insert 31, and then flow out through holes 39 of the insert 31 and into the gaps 42. The nose piece 31 is welded to the inner endwall at points labeled as 43 in FIG. 9. Cooling air flows into the impingement tube 33 from the bottom through the opening or inlet extension.

In operation, the nose piece and the impingement tube 33 are secured within the openings of the inner and the outer endwalls to form the vane assembly. Cooling air under pressure is supplied to the first impingement tube from the bottom and to the second impingement tube 16 and third impingement tube 17 from the top. Cooling air flows through the impingement holes within the tubes to provide impingement cooling to the nose piece 31 or the cavities in which the second and third impingement tubes are located. Cooling air from the first impingement tube provides impingement cooling for the inner walls of the nose piece 31, and then flows through the showerhead film cooling holes or other film cooling holes to provide a layer of film cooling air over the leading edge surface and pressure side and suctions side surfaces of the airfoil. Because of the separate nose piece with showerhead film cooling holes, and the presence of the long endwall overhangs, the showerhead film cooling holes can be angled at much less than the 45 degrees in which the prior art first stage vane is limited.

Major design features and advantages of the cooling concept over the prior art conventional cast vane are described below. The de-coupled leading edge nose piece allows for the use of shallow angled showerhead film cooling holes at any orientation and eliminates the constraint by the endwall overhang geometry. The newly formed spacer provides for improved cooling along the horseshoe vortex region and improved the film formation relative to the prior art discrete film cooling hole injection method. Film cooling holes on the root of the airfoil leading edge provides for convective and film cooling for the airfoil leading edge as well as baffling the down draft hot gas core air for the leading edge. The ejected film cooling air migrates down to the airfoil endwall and provides film cooling for the horseshoe vortex region on the endwall. Film cooling holes discharged within the spacer provide convective and film cooling for the airfoil root section around the pressure and suction sides while significantly reducing the local metal temperature and eliminating the over temperature issue for the airfoil leading edge fillet region. The newly formed cooling space increases the uniformity of the film cooling and insulates the leading edge root section structure from the passing hot core gas, and therefore establishes a durable film cooling for the downstream root section and cools the airfoil leading edge horseshoe vortex region. The newly formed cooling space creates additional local volume for the expansion of the hot gas core air, slows down the secondary flow as well as the velocity and pressure gradients, and thus weakens the horseshoe vortex and minimizes the high heat transfer coefficient created due to the horseshoe vortex. The newly formed cooling space may desensitize the leading edge horseshoe vortex. This minimizes cooling loses or degradation of the film for the endwall downstream film cooling and therefore yields a more effective film cooling for the film development and maintenances of it. The newly formed cooling space extends the cooling air continuously along the interface of the airfoil leading edge versus endwall location and therefore minimizes the thermally induces stress by eliminating the discrete cooling hole which is separated by the un-cooled area characteristic of the prior art vane cooling design.

I claim the following:

1. A turbine stator vane comprising:

an airfoil extending between an outer endwall and an inner endwall;

the airfoil having a pressure side wall and a suction side wall but without a leading edge region;

an end cap with an inner opening on the outer endwall;

an opening formed in the inner endwall;

a leading edge region nose piece secured within the end cap and the opening;

the two endwalls and the two openings forming two gaps; and, a streamwise film cooling hole formed in the nose piece to discharge cooling air into the two gaps.

2. A turbine stator vane comprising:

an airfoil extending between an outer endwall and an inner endwall;

the airfoil having a pressure side wall and a suction side wall but without a leading edge region;

a first opening formed in the outer endwall;

a second opening formed in the inner endwall;

a leading edge region forming nose piece secured within the first and second openings and forming a leading edge region for the airfoil;

an impingement tube having a closed end and an opened end for supplying cooling air to the tube;

the impingement tube having an arrangement of impingement cooling holes to direct impingement cooling air to a backside surface of the leading edge section of the nose piece; and, the open end of the impingement tube outside of the inner endwall to supply cooling air to the impingement cooling holes.

3. The turbine stator vane of claim 2, and further comprising:

the impingement tube is a closed round tube to maintain the cooling air at the same pressure at the open end of the tube.

4. The turbine stator vane of claim 2, and further comprising:

the leading edge region forming nose piece includes a plurality of film cooling holes directed to discharge film cooling air at an angle to a streamwise direction of the airfoil.

5. The turbine stator vane of claim 2, and further comprising:

the leading edge region forming nose piece includes a first plurality of film cooling directed to discharge film cooling air toward the outer endwall and a second plurality of film cooling directed to discharge film cooling air toward the inner endwall.

6. The turbine stator vane of claim 2, and further comprising:

the airfoil includes two impingement chamber separated by a rib; and, an impingement tube secured within the two impingement chambers.

7. The turbine stator vane of claim 2, and further comprising:

the outer and inner endwalls are both overhung endwalls;

the nose piece includes film cooling holes angled from a streamwise direction of the airfoil.

8. The turbine stator vane of claim 2, and further comprising:

The insert tube is contained fully within the nose piece.

9. A turbine stator vane comprising:

an airfoil extending between an outer endwall and an inner endwall;

the outer endwall and the inner endwall both being overhung endwalls;

the airfoil having a pressure side wall and a suction side wall but without a leading edge region;

a nose piece forming a leading edge region for the airfoil removably secured between the outer endwall and the inner endwall;

a showerhead arrangement of film cooling holes formed in the nose piece at an angle that cannot be formed in the nose piece with the nose piece in position within the airfoil;

the nose piece is secured within openings formed in the two endwalls that form gaps between the nose piece and the two endwalls; and, the nose piece includes streamwise directed film cooling holes to discharge cooling air into the two gaps.

10. The turbine stator vane of claim 9, and further comprising:

an insert tube with an arrangement of impingement cooling holes to direct impingement cooling air to a backside surface of the leading edge region of the nose piece; and, the insert tube being a closed tube with an inlet end so that cooling air entering the tube will maintain a pressure to produce impingement cooling.

11. The turbine stator vane of claim 9, and further comprising:

the nose piece forms an enclosed chamber to fully enclose the insert turbine.

* * * * *